US005679065A

United States Patent [19]

Henderson

[11] Patent Number: 5,679,065

[45] Date of Patent: Oct. 21, 1997

[54] WAFER CARRIER HAVING CARRIER RING ADAPTED FOR UNIFORM CHEMICAL-MECHANICAL PLANARIZATION OF SEMICONDUCTOR WAFERS

[75] Inventor: Gary O. Henderson, Meridian, Id.

[73] Assignee: Micron Technology, Inc., Boise, Id.

[21] Appl. No.: 606,381

[22] Filed: Feb. 23, 1996

[51] Int. Cl.[6] ..... B24B 5/00

[52] U.S. Cl. ..... 451/290; 451/287; 451/288; 451/289; 451/41; 451/391; 451/378; 451/370

[58] Field of Search ..... 451/287, 288, 451/289, 41, 42, 63, 391, 370, 378

[56] References Cited

U.S. PATENT DOCUMENTS 4,519,168 5/1985 Cesna ..... 451/287
5,204,082 4/1993 Shendon et al. ..... 451/41
5,433,650 7/1995 Winebarger ..... 451/287
5,441,444 8/1995 Nakajima ..... 451/288
5,449,316 9/1995 Strasbaugh ..... 451/287

*Primary Examiner*—Robert A. Rose
*Assistant Examiner*—George Nguyen
*Attorney, Agent, or Firm*—Seed and Berry LLP

[57] ABSTRACT

The present invention is a carrier ring for a semiconductor wafer carrier in which an exposed surface of the carrier ring facing a polishing pad either slopes, is stepped, or is curved away from the polishing pad from the inner periphery to the outer periphery of the carrier ring. As a result, the exposed surface of the carrier ring is spaced farther from the polishing pad adjacent its outer periphery than it is adjacent its inner periphery, thereby increasing the volume and uniformity of slurry transported beneath the wafer.

10 Claims, 4 Drawing Sheets

WAFER CARRIER HAVING CARRIER RING ADAPTED FOR UNIFORM CHEMICAL-MECHANICAL PLANARIZATION OF SEMICONDUCTOR WAFERS

TECHNICAL FIELD

The present invention relates to chemical-mechanical planarization of semiconductor wafers, and more specifically to an improved configuration for a carrier ring that surrounds a semiconductor wafer during chemical-mechanical planarazation.

BACKGROUND OF THE INVENTION

Chemical-mechanical planarization ("CMP") processes are frequently used to planarize the surface layer of a wafer in the production of ultra-high density integrated circuits. In a typical CMP process, a planarizing surface on a polishing pad is covered with a slurry solution containing small, abrasive particles and reactive chemicals. A wafer is mounted in a wafer carrier having a planar wafer support surface surrounded by a circular cattier ring. The wafer carrier is positioned opposite the polishing pad with the wafer in contact with the polishing pad. The wafer and/or the polishing pad are then moved relative to one another allowing the abrasive particles in the slurry to mechanically remove the surface of the wafer, and the reactive chemicals in the slurry to chemically remove the surface of the wafer.

CMP processes must consistently and accurately planarize a uniform, planar surface on the wafer at a desired end-point. Many microelectronic devices are typically fabricated on a single wafer by depositing layers of various materials on the wafer, and manipulating the wafer and the other layers of material with photolithographic, etching, and doping processes. In order to manufacture ultra-high density integrated circuits, CMP processes must provide a highly planar surface that is uniform across the entire surface so that the geometries of the component parts of the circuits may be accurately positioned across the full surface of the wafer. Integrated circuits are generally patterned on a wafer by optically or electromagnetically focusing a circuit pattern on the surface of the wafer. If the surface of the wafer is not highly planar, the circuit pattern may not be sufficiently focused in some areas, resulting in defective devices. Therefore, it is important to consistently and accurately make virtually the entire surface of the wafer uniformly planar.

Several factors influence the uniformity of a planarized surface of a wafer, one of which is the distribution of the slurry between the polishing pad and the wafer. A uniform distribution of slurry between the polishing pad mad the wafer results in a more uniform surface on the wafer because the abrasive particles and the chemicals in the slurry will react more evenly across the whole wafer.

FIG. 1 illustrates a conventional chemical-mechanical planarization machine 10 with a platen 20, a wafer carrier 30, and a polishing pad 40. The platen 20 has a top surface 22 upon which the polishing pad 40 is positioned. A drive assembly 26 may rotate the platen 20 as indicated by arrow A. The motion of the platen 20 is imparted to the polishing pad 40 because the polishing pad 40 is adhered to the top surface 22 of the platen 20.

The wafer carrier 30 has a wafer support surface 32 to which a wafer 34 may be attached by drawing a vacuum on the backside of the wafer. A resilient wafer pad 36 may be positioned between the wafer 34 and the support surface 32 to enhance the connection between the wafer 34 and the wafer carrier 30. However, the wafer 34 can be mounted directly on the support surface 32, and it may be secured there by means other than a vacuum. The wafer carrier 30 may have an actuator assembly 38 attached to it for imparting, lateral, axial and/or rotational motion as indicated by arrows B, C and D, respectively. The actuator assembly 38 is generally attached to the wafer carrier 30 by a gimbal joint (not shown) that allows the wafer carrier 30 to pivot freely about the three orthogonal axes centered at the end of the actuator 38. In operation, an exposed surface 44 of the wafer 34 is placed in contact with an exposed surface 42 of the polishing pad 40 on which a quantity of slurry 48 is placed.

As best illustrated in FIG. 2, the wafer carrier 30, as well as the platen 20 and polishing pad 40, are circular, with the diameter of the polishing pad 40 and the platen 20 being substantially larger than the diameter of the wafer carrier 30. The wafer carrier 30 illustrated in FIGS. 1 and 2 is a commonly used wafer carrier manufactured by Westech Systems, Inc., although wafer carriers manufactured by others have a similar configuration.

The wafer carrier 30 is shown in greater detail in FIG. 3. The wafer carrier 30 includes a circular carrier ring 50 which surrounds the wafer pad 36 and the wafer 34. The carrier ring 50 has an exposed planar surface 52 which projects below the lower surface of the wafer pad 36 but not as far as the exposed surface 44 of the wafer 34. The primary purpose of the carrier ring 50 is to keep the wafer 34 in position on the wafer pad 36 as forces tangential to the exposed surface 44 of the wafer 34 are imparted to it by the polishing pad 40 (FIG. 1) during polishing.

Although the wafer carrier 30 shown in FIGS. 1–3 and other similar wafer carriers have generally provided acceptable performance in the past, increasingly stringent planarization standards, coupled with the desire to be able to use substantially the entire wafer surface, has led to a need for an improved carrier ring that solves some of the problems associated with conventional carrier rings like those shown in FIGS. 1–3. More specifically, applicant has discovered that substantially the entire exposed surface 52 of the carrier ring 50 contacts the polishing pad 40 after the polishing pad 40 has been compressed by the wafer 34, thereby preventing the slurry 48 from being uniformly distributed across the exposed surface 44 of the wafer 34. In particular, the contact between the exposed surface 52 of the carrier ring 50 ,and the surface of the polishing pad 40 tends to "squeegee" slurry 48 away from the edge of the exposed surface 44 of the wafer 34, thereby causing the polishing of the surface 44 to be insufficiently uniform. Attempts have been made to force additional slurry beneath the wafer 34 by forming radial slots or grooves in the carrier ring 50. While this approach has resulted in a greater quantity of slurry 48 being transported to the wafer 34 and polishing pad 40, it has, if anything, exacerbated the non-uniformity of the distribution of the slurry 48 between the wafer 34 and the polishing pad 40. The use of radial slots or grooves has therefore failed to provide an acceptably uniform surface across the entire exposed surface 44 of the wafer 34.

Another problem with the carrier ring 50 used in the wafer carrier 30 of FIG. 3 is that it is sometimes incapable of maintaining the wafer 34 in position on the support surface 32 or the wafer pad 36 because the exposed surface 52 of the cattier ring 50 is positioned an insufficient distance below the support surface 32. As a result, the exposed surface 44 of the wafer 34 projects a substantial distance below the exposed surface 52 of the carrier ring 50, as illustrated in FIG. 3. For example, in practice, the exposed surface 44 of the wafer 34 may project 0.017 inch below the exposed surface 52 of the carrier ring 50. When the wafer 34 slips from its position beneath the wafer carrier 30, it is usually broken, thereby requiting that the wafer 34 be discarded. While the carrier ring 50 could more securely hold the wafer 34 in position by positioning the exposed surface 52 of the carrier ring 50 further below the support surface 32, doing so would exacerbate the above-described non-uniformity of slurry distribution between the exposed surface 44 of the wafer 34 and the polishing pad 40.

There is therefore a need for a wafer carrier that securely maintains the wafer in position in the wafer carrier yet also allows a uniform distribution of slurry between the exposed surface of the wafer and the polishing pad.

SUMMARY OF THE INVENTION

The inventive machine for chemical-mechanical planarization of semiconductor wafers includes a polishing pad positioned on a moveable platen, a wafer carrier positioned opposite the polishing pad so that a wafer mounted in the wafer carrier can engage the polishing pad, and a drive mechanism for causing relative movement between the platen and the wafer carrier. The wafer carrier has a circular, planar wafer support surface with a diameter that is at least as large as the diameter of the wafer. The wafer is mounted on the support surface, either directly or through a wafer pad. A carrier ring surrounds the support surface and projects toward the polishing pad to surround the wafer. The carrier ring has an exposed surface facing the polishing pad, with the exposed surface being closer to the polishing pad at the inner edge of the carrier ring than it is at the outer edge of the carrier ring.

The exposed surface of the carrier ting may have a variety of configurations. For example, the exposed surface of the carrier ring may be planar so that the exposed surface slopes uniformly toward the polishing pad from the outer edge of the carrier ring to the inner edge of the carrier ring. The exposed surface of the carrier ring may also form a series of steps that extend toward the polishing pad from the outer edge of the carrier ring to the inner edge of the carrier ring. As another example, the exposed surface of the carrier ring may be curved with the exposed surface being generally parallel to the polishing pad at its inner edge and the exposed surface sloping away from the polishing pad at its outer edge. Regardless of the configuration of the exposed surface of the carrier ring, the inner edge of the exposed surface is preferably substantially flush with the surface of the wafer that is exposed to the polishing pad when the wafer is placed in the wafer carrier.

DETAILED DESCRIPTION OF THE INVENTION

Figure 1:
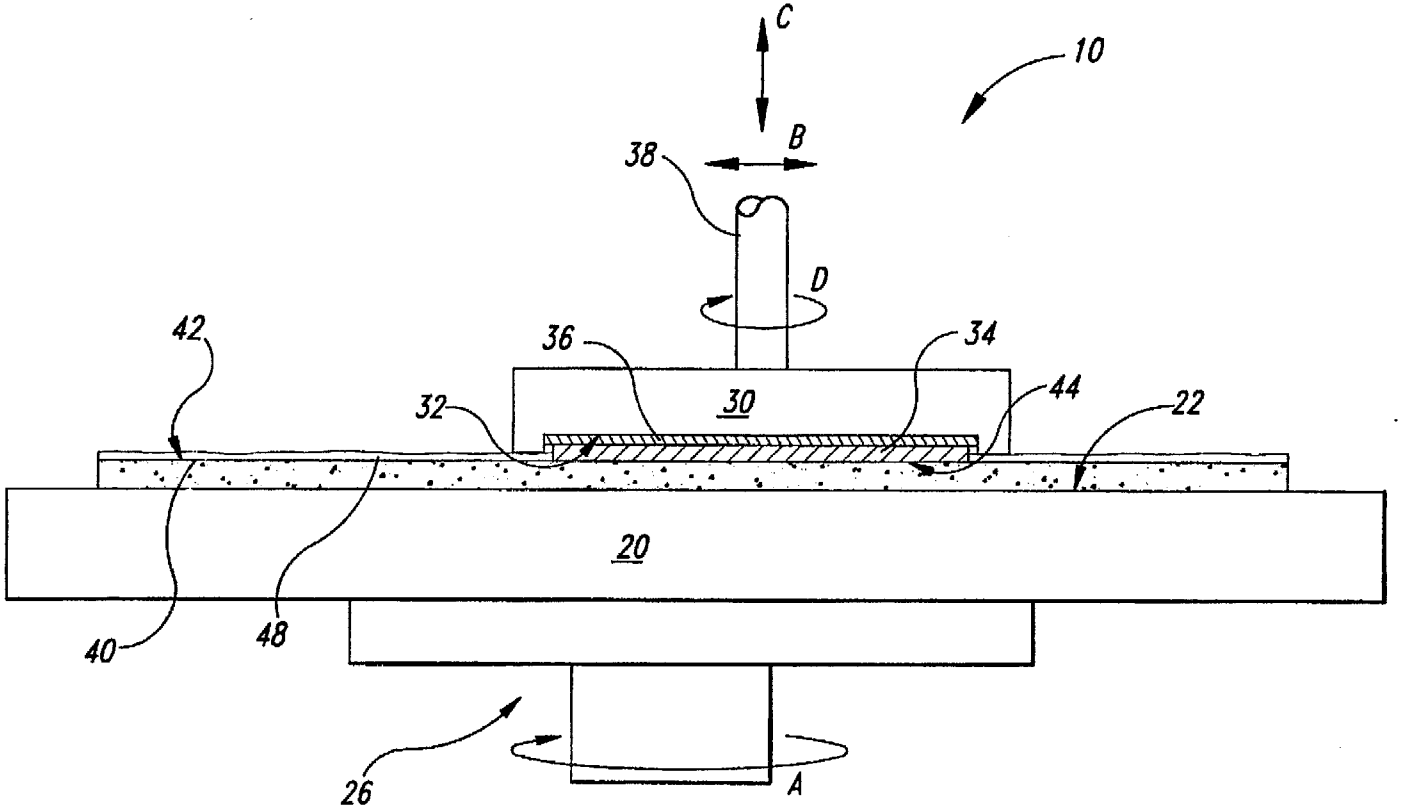
Fig. 1 (Prior Art)
FIG. 1 is a schematic cross-sectional view of a prior art chemical-mechanical planarization machine.
Figure 2:
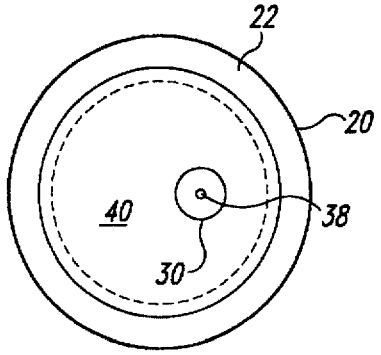
Fig. 2 (Prior Art)
FIG. 2 is a schematic top plan view of the prior art chemical-mechanical planarization machine of FIG. 1.
Figure 3:
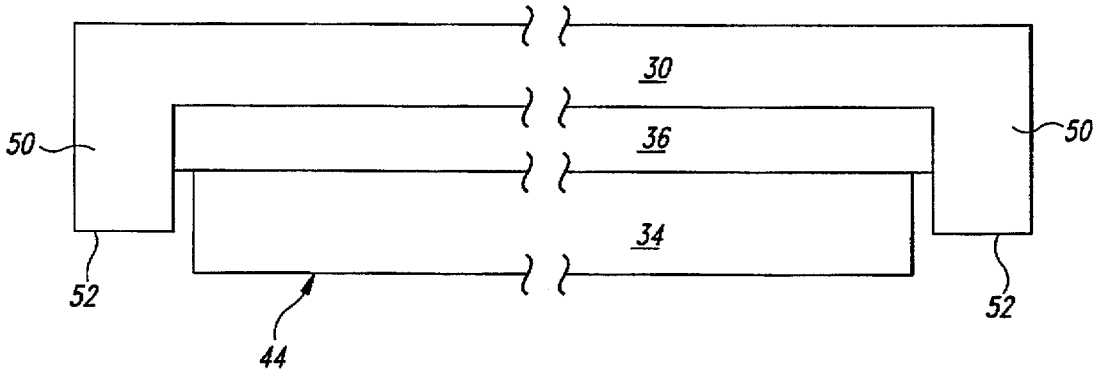
Fig. 3 (Prior Art)
FIG. 3 is a schematic cross-sectional view of a prior art wafer carrier of the type used in the chemical-mechanical planarization machine of FIGS. 1 and 2.
Figure 4:
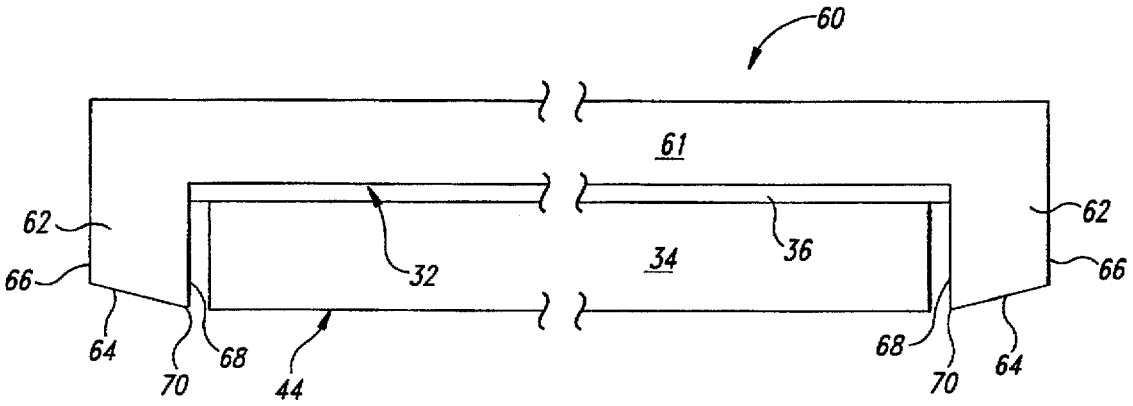
FIG. 4 is a schematic cross-sectional view of a preferred embodiment of a wafer carrier in accordance with the invention for use in a chemical-mechanical planarization machine.

A wafer carrier 60 having a preferred embodiment of the invention carrier ring 62 projecting from a wafer carrier body 61 is shown in FIG. 4, in which components that are identical to the prior ate wafer carrier 30 shown in FIGS. 1–3 have been designated with the same reference numerals. Thus, the wafer carrier 60 shown in FIG. 4 has a planar wafer support surface 32 carrying a wafer pad 36 on which a circular wafer 34 is mounted. However, as mentioned above, the wafer 34 may also be mounted directly on the support surface 32.

Unlike the prior art carrier ring 50 shown in FIG. 3, the carrier ring 62 used in the inventive wafer carrier 60 has an exposed planar surface 64 that is generally sloped downwardly from the outer periphery 66 to the inner periphery 68 of the carrier ring 62. Also unlike the prior art carrier ring 50 shown in FIG. 3 in which the exposed surface 44 of the wafer 34 projects a substantial distance (e.g., 0.1 inch) below the exposed surface 52 of the carrier ring 50, the exposed surface 64 of the carrier ring 62 may be substantially flush with the exposed surface 44 of the wafer 34. As a result, the carrier ring 62 is able to more securely maintain the wafer 34 in position in the wafer carrier 60. The preferred embodiment of the inventive carrier ring 62 therefore results in a reduced probability of breakage of the wafer 34 as compared to the use of conventional wafer carriers.

Even though the exposed surface 64 of the carrier ring 62 may be substantially flush with the exposed surface 44 of the wafer 34, it does not substantially impede the transportation of slurry 48 (FIG. 1) to the wafer 34 or the uniformity of the slurry 48 on the exposed surface 44 of the wafer 34. The reason for this improvement in slurry transport appears to be that the carrier ring 62 contacts the polishing pad 40 over relatively little surface area so that there is little tendency for slurry 48 to be "squeegeed" from beneath the carrier ring 62. Because of the slope of the exposed surface 64 of the carrier ring 62, most of the exposed surface 64 is spaced substantially above the polishing pad 40 (FIG. 1) so that the carrier ring 62 does not substantially impede the transport of slurry 48 to the exposed surface 44 of the wafer 34.

In addition to more securely holding the wafer 34 in the wafer carrier 60 and allowing a greater and more uniform transport of slurry 48 to the exposed surface 44 of the wafer 34, the inventive cattier ring 62 absorbs relatively little of the down-force exerted on the wafer cattier 60 as compared to prior art wafer carriers 30. With the conventional carrier ring 50 illustrated in FIG. 3, the area of the exposed surface 52 of the carrier ring 50 contacting the polishing pad 40 is a relatively large percentage of the area of the exposed surface 44 of the wafer 34 contacting the polishing pad. As a result, the down-force polishing pressure is relatively difficult to control. In contrast, with the preferred embodiment of the inventive carrier ring 62 illustrated in FIG. 4, the area of the exposed surface 64 of the carrier ring 62 contacting the polishing pad 40 is a relatively small percentage of the area of the exposed surface 44 of the wafer 34 contacting the polishing pad 40 thus making the down-force polishing pressure relatively easy to control. This better control of the down-force polishing pressure further increases the uniformity of the slurry 48 beneath the wafer 34 and the resulting polish of the wafer 34.

Although various dimensions can be used, the preferred embodiment of the wafer carrier 60 illustrated in FIG. 4 has an exposed surface 64 adjacent the inner edge of the carrier ring 62 that is within 0.001 inch of the level of the exposed surface 44 of the wafer 34, forms a "pocket depth" (i.e., the depth of the recess formed by the carrier ring 62) of 0.025–0.026 inch (as compared to prior art pocket depths of 0.013–0.014 inch) and has its inner 0.03 inches parallel with the exposed surface 44 of the wafer 34 at 70 so that a sharp edge is not formed along the inner edge of the exposed surface 64 of the carrier ring 62. Although the carrier ring 62 can have various slopes and dimensions, in the preferred embodiment illustrated in FIG. 4 the carrier ring 62 has a width of 0.5–0.625 inches, and the exposed surface 64 has an outer edge that is 0.125 inches higher than its inner edge resulting in a slope of between 0.2 (i.e., 0.125/0.625) and 0.25 (i.e., 0.125/0.5).

Figure 5:
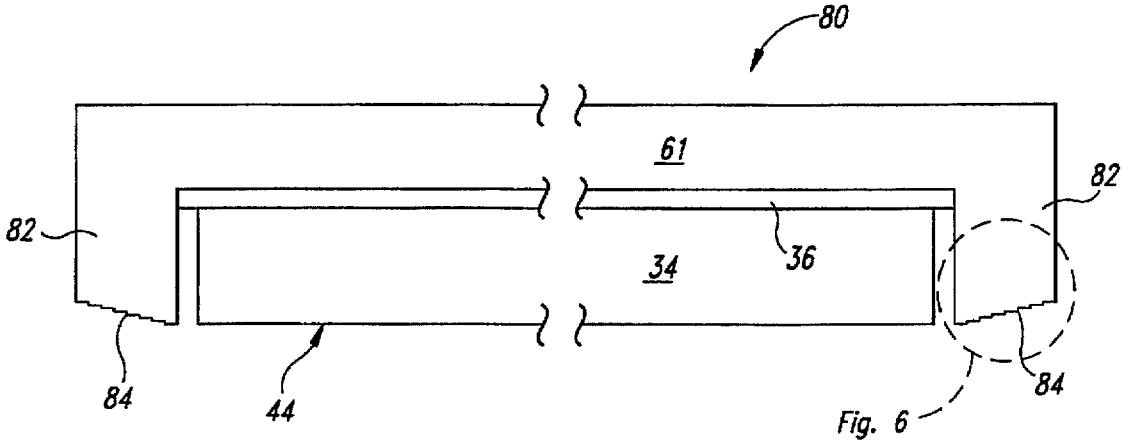
FIG. 5 is a schematic cross-sectional view of an alternative embodiment of a wafer carrier in accordance with the invention for use in a chemical-mechanical planarization machine.
Figure 6:
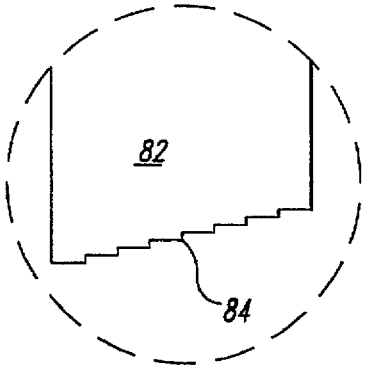
FIG. 6 is a detailed cross-sectional view of the exposed surface of a carrier ring used in the wafer carrier of FIG. 5.

A wafer carrier 80 using an alternative embodiment of the inventive carrier ring 82 is illustrated in FIGS. 5 and 6. The carrier ring 82 differs from the carrier ring 62 shown in FIG. 4 by having an exposed surface 84 that is stepped rather than planar as is the exposed surface 64 of the carrier ring 62. However, since the steps approximate the planar exposed surface 64 of the carrier ring 62, it has all of the advantages of the carrier ring 62 of FIG. 4.

Figure 7:
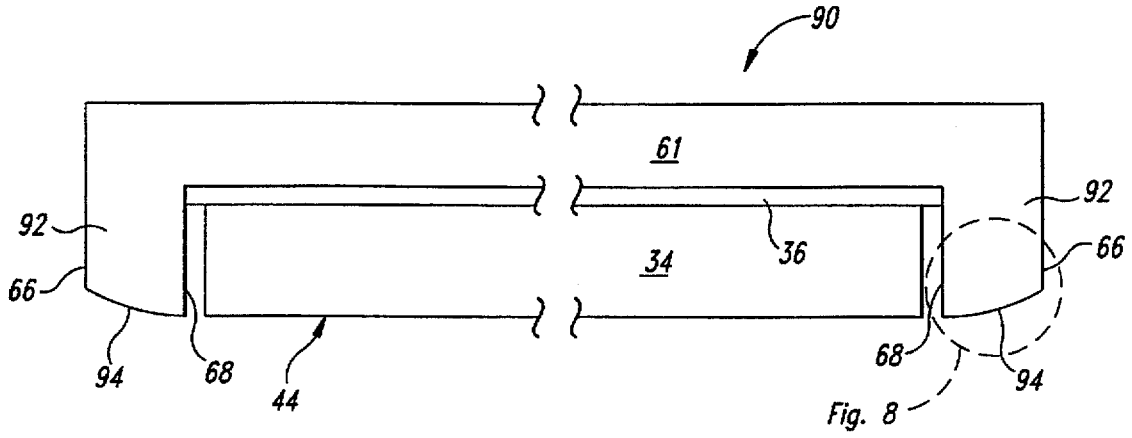
FIG. 7 is a schematic .cross-sectional view of still another embodiment of a wafer carrier in accordance with the invention for use in a chemical-mechanical planarization machine.
Figure 8:
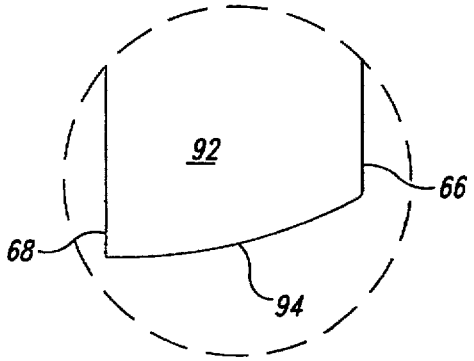
FIG. 8 is a detailed cross-sectional view of the exposed surface of a carrier ring used in the wafer carrier of FIG. 7.

A wafer carrier 90 using still another embodiment of the inventive carrier ring 92 is illustrated in FIGS. 7 and 8. The carrier ring 92 differs from the carrier rings 62, 82 shown in FIGS. 4 and 5–6, respectively, by having an exposed surface 94 that is curved rather than planar. More specifically, the exposed surface 94 adjacent the inner periphery 68 is parallel to the exposed surface 44 of the wafer 34, and it curves upwardly toward the outer periphery 66 of the carrier ring 92.

While the detailed description above has been expressed in terms of specific examples, those skilled in the art will appreciate that many other structures could be used to accomplish the purpose of the disclosed procedure. For example, carrier ring configurations other than those illustrated herein will apparent to those skilled in the ate, and they may be used without departing from the inventive concept claimed herein. Accordingly, it can be appreciated that various modifications of the above-described embodiment may be made without departing from the spirit and scope of the invention.

I claim:

1. A wafer carrier for supporting a semiconductor wafer during mechanical or chemical-mechanical planarization, comprising:

a wafer carrier body including a circular, planar support surface having a diameter that is at least as large as the diameter of a wafer adapted to be supported on said support surface either directly or through a wafer pad; and a carrier ring surrounding said support surface and projecting beyond said support surface, said carrier ring having an exposed surface extending from the inner periphery of said carrier ring adjacent said support surface to the outer periphery of said carrier ring, the spacing of said exposed surface beyond said support surface being greater at the inner periphery of said carrier ring than it is at the outer periphery of said carrier ring, said exposed surface being substantially planar from the inner periphery of said carrier ring to the outer periphery of said carrier ring so that said exposed surface generally slopes uniformly from the outer periphery of said carrier ring to the inner periphery of said carrier ring.

2. The wafer carrier of claim 1 herein a relatively narrow strip of said exposed surface adjacent the inner periphery of said carrier ring is generally parallel to the support surface of said wafer carrier.

3. A wafer carrier for supporting a semiconductor wafer during mechanical or chemical-mechanical planarization, comprising:

a wafer carrier body including a circular, planar support surface having a diameter that is at least as large as the diameter of a wafer adapted to be supported on said support surface either directly or through a wafer pad; and a carrier ring surrounding said support surface and projecting beyond said support surface, said carrier ring having an exposed surface extending from the inner periphery of said carrier ring adjacent said support surface to the outer periphery of said carrier ring, the spacing of said exposed surface beyond said support surface being greater at the inner periphery of said carrier ring than it is at the outer periphery of said carrier ring, said exposed surface forming a series of steps that extend from the outer periphery of said carrier ring to the inner periphery of said carrier ring.

4. A wafer carrier for supporting a semiconductor wafer during mechanical or chemical-mechanical planarization, comprising:

a wafer carrier body including a circular, planar support surface having a diameter that is at least as large as the diameter of a wafer adapted to be supported on said support surface either directly or through a wafer pad; and a carrier ring surrounding said support surface and projecting beyond said support surface, said carrier ring having an exposed surface extending from the inner periphery of said carrier ring adjacent said support surface to the outer periphery of said carrier ring, the spacing of said exposed surface beyond said support surface being greater at the inner periphery of said carrier ring than it is at the outer periphery of said carrier ring, said exposed surface being curved with said exposed surface being generally parallel to the support surface of said wafer carrier at the inner periphery of said carrier ring and said exposed surface sloping toward the outer periphery of said carrier ring.

5. A wafer carrier for supporting a semiconductor wafer during mechanical or chemical-mechanical planarization, comprising:

a wafer carrier body including a circular, planar support surface having a diameter that is at least as large as the diameter of a wafer adapted to be supported on said support surface either directly or through a wafer pad; and a carrier ring surrounding said support surface and projecting beyond said support surface, said carrier ring having an exposed surface extending from the inner periphery of said carrier ring adjacent said support surface to the outer periphery of said carrier ring, the spacing of said exposed surface beyond said support surface being greater at the inner periphery of said carrier ring than it is at the outer periphery of said carrier ring, said exposed surface adjacent the inner periphery of said carrier ring being substantially flush with an exposed surface of said wafer when said wafer is placed in said wafer carrier.

6. A machine for mechanical or chemical-mechanical planarization of a semiconductor wafer, comprising:

a platen;

a polishing pad positioned on the moveable platen, the polishing pad having a planarizing surface with an operational zone for planarization of the wafer;

a wafer carrier positioned opposite the polishing pad so that a wafer adapted to be placed in said wafer carrier can engage said polishing pad, said wafer carrier including a circular, planar support surface with a diameter that is at least as large as the diameter of a wafer adapted to be supported on said support surface either directly or through a wafer pad, and a carrier ring surrounding said support surface and having an exposed surface facing said polishing pad, said exposed surface being closer to said polishing pad at the inner periphery of said carrier ring than it is at the outer periphery of said carrier ring, said exposed surface being substantially planar from the inner periphery of said carrier ring to the outer periphery of said carrier ring so that said exposed surface generally slopes uniformly toward said polishing pad from the outer periphery of said carrier ring to the inner periphery of said carrier ring; and a drive mechanism for causing relative movement between said platen and said wafer carrier.

7. The chemical-mechanical planarization machine of claim 6 wherein a relatively narrow strip of said exposed surface adjacent the inner periphery of said carrier ring is generally parallel to the planarizing surface of said polishing pad.

8. A machine for mechanical or chemical-mechanical planarization of a semiconductor wafer, comprising:

a platen;

a polishing pad positioned on the moveable platen, the polishing pad having a planarizing surface with an operational zone for planarization of the wafer;

a wafer carrier positioned opposite the polishing pad so that a wafer adapted to be placed in said wafer carrier can engage said polishing pad, said wafer carrier including a circular, planar support surface with a diameter that is at least as large as the diameter of a wafer adapted to be supported on said support surface either directly or through a wafer pad, and a carrier ring surrounding said support surface and having an exposed surface facing said polishing pad, said exposed surface being closer to said polishing pad at the inner periphery of said carrier ring than it is at the outer periphery of said carrier ring, said exposed surface forming a series of steps that extend toward said polishing pad from the outer periphery of said carrier ring to the inner periphery of said carrier ring; and a drive mechanism for causing relative movement between said platen and said wafer carrier.

9. A machine for mechanical or chemical-mechanical planarization of a semiconductor wafer, comprising:

a platen;

a polishing pad positioned on the moveable platen, the polishing pad having a planarizing surface with an operational zone for planarization of the wafer;

a wafer carrier positioned opposite the polishing pad so that a wafer adapted to be placed in said wafer carrier can engage said polishing pad, said wafer carrier including a circular, planar support surface with a diameter that is at least as large as the diameter of a wafer adapted to be supported on said support surface either directly or through a wafer pad and a carrier ring surrounding said support surface and having an exposed surface facing said polishing pad, said exposed surface being closer to said polishing pad at the inner periphery of said carrier ring than it is at the outer periphery of said carrier ring, said exposed surface being curved with said exposed surface being generally parallel to said polishing pad at the inner periphery of said carrier ring and said exposed surface sloping away from said polishing pad at the outer periphery of said carrier ring; and a drive mechanism for causing relative movement between said platen and said wafer carrier.

10. A machine for mechanical or chemical-mechanical planarization of a semiconductor wafer, comprising:

a platen;

a polishing pad positioned on the moveable platen, the polishing pad having a planarizing surface with an operational zone for planarization of the wafer;

a wafer carrier positioned opposite the polishing pad so that a wafer adapted to be placed in said wafer carrier can engage said polishing pad, said wafer carrier including a circular, planar support surface with a diameter that is at least as large as the diameter of a wafer adapted to be supported on said support surface either directly or through a wafer pad, and a carrier ring surrounding said support surface and having an exposed surface facing said polishing pad, said exposed surface being closer to said polishing pad at the inner periphery of said carrier ring than it is at the outer periphery of said carrier ring, said exposed surface adjacent the inner periphery of said carrier ring being substantially flush with the surface of said wafer exposed to said polishing pad when said wafer is placed in said wafer carrier; and a drive mechanism for causing relative movement between said platen and said wafer carrier.

* * * * *

UNITED STATES PATENT AND TRADEMARK OFFICE

CERTIFICATE OF CORRECTION

| | | |
|---|---|---|
| PATENT NO. | : | 5,679,065 |
| DATED | : | October 21, 1997 |
| INVENTOR(S) | : | Gary O. Henderson |

It is certified that error appears in the above identified patent and that said Letters Patent is hereby corrected as shown below:

In column 6, claim 2, line 8, after "claim 1" delete "herein" and substitute therefor -- wherein --.

In column 8, claim 9, line 17, after "pad" insert therefor --, --.

Signed and Sealed this

Twenty-first Day of July, 1998

Bruce Lehman

*Attest:*

BRUCE LEHMAN

*Attesting Officer*

*Commissioner of Patents and Trademarks*